US006635317B1

(12) United States Patent
Casner, Jr.

(10) Patent No.: US 6,635,317 B1
(45) Date of Patent: Oct. 21, 2003

(54) METHOD FOR COATING METALLIC TUBES WITH CORROSION-RESISTANT ALLOYS

(75) Inventor: Kenneth Casner, Jr., 37 Mason St., Calumet City, IL (US) 60409

(73) Assignees: Kenneth Casner, Sr., Calumet City, IL (US); Kenneth Casner, Jr., Calumet City, IL (US); Joseph Casner, Calumet City, IL (US)

( * ) Notice: Subject to any disclaimer, the term of this patent is extended or adjusted under 35 U.S.C. 154(b) by 0 days.

(21) Appl. No.: 10/189,118

(22) Filed: Jul. 2, 2002

(51) Int. Cl.[7] ..... B05D 1/12; B05D 7/22

(52) U.S. Cl. ..... 427/546; 427/183; 427/231; 427/234; 427/241

(58) Field of Search ..... 427/545, 546, 427/183, 190–192, 231, 234, 239–241, 383.7, 398.3; 428/34.1, 586

(56) References Cited

U.S. PATENT DOCUMENTS

| | | | | |
|---|---|---|---|---|
| 2,046,914 | A | | 7/1936 | Kormann et al. |
| 2,178,419 | A | * | 10/1939 | Clark et al. |
| 2,470,689 | A | * | 5/1949 | Crampton et al. |
| 2,880,109 | A | * | 3/1959 | Current et al. |
| 3,007,810 | A | | 11/1961 | Hobrock |
| 3,056,692 | A | | 10/1962 | Kitada |
| 3,392,009 | A | * | 7/1968 | Holmes et al. |
| 3,974,306 | A | | 8/1976 | Inamura et al. |
| 4,382,421 | A | | 5/1983 | Warren et al. |
| 4,408,561 | A | * | 10/1983 | Yokoyama et al. |
| 4,490,411 | A | | 12/1984 | Feder |
| 4,869,203 | A | | 9/1989 | Pinkhasov |
| 5,059,453 | A | | 10/1991 | Bernsten, Jr. |
| 5,202,160 | A | * | 4/1993 | Schuppe et al. |
| 5,413,638 | A | | 5/1995 | Bernstein, Jr. et al. |
| 5,558,150 | A | | 9/1996 | Sponseller |
| 5,919,307 | A | | 7/1999 | Bernstein, Jr. |
| 6,019,845 | A | | 2/2000 | Nakakoshi |

* cited by examiner

*Primary Examiner*—Fred J. Parker
(74) *Attorney, Agent, or Firm*—Marshall, Gerstein & Borun LLP

(57) ABSTRACT

A method for coating an interior surface of a metallic tube with a corrosion-resistant and/or an abrasion-resistant alloy. The method includes placing an alloy within a tube, enclosing the open ends of the tube with end caps, at least one of which is vented, heating the tube by applying current across the tube sufficient to heat the tube and melt the alloy, and spinning tube by the longitudinal axis of the tube to distribute the molten alloy along the interior surface of the tube using the centrifugal forces created by the spinning. An apparatus suitable for carrying out the above method is also disclosed.

23 Claims, 3 Drawing Sheets

METHOD FOR COATING METALLIC TUBES WITH CORROSION-RESISTANT ALLOYS

TECHNICAL FIELD

Methods and apparatuses for coating the interior surface of a casing, pipe or tube, with an alloy, such as a corrosion-resistant alloy, are disclosed. More specifically, methods and apparatuses are disclosed for metallizing the interior surface of metallic tubular bodies, to provide, for example, metallic casings with interior surfaces, coated with a corrosion-resistant and/or abrasion-resistant alloy coating to extend the useful life of the casings in harsh operating environments.

BACKGROUND OF THE RELATED ART

In many fields of endeavors, metallic casing pipes are used to transport fluids. Often, due to the extended length of the casings or tubings, ordinary or low-cost steel is used to fabricate the casing in order to reduce capital costs. However, the interior surface of metal casings are often exposed to corrosive or abrasive environments. For example, oil well casings are often exposed to high salinity water or acid, both of which promote corrosion of ordinary steels. In the area of chemical refining, the fluids transported through the casings may be abrasive or corrosive, or both.

Thus, it is often desirable to coat the interior surface of a steel casing with an alloy that is corrosion-resistant, abrasive-resistant, or both. While the interior coating of metallic casing adds to the cost of the casing, the coating of the interior surface of a steel casing is substantially cheaper than fabricating the entire casing from a corrosion-resistant and/or abrasive-resistant alloy.

The use of plating techniques is undesirable because plating, such as chrome plating, requires the use of chemical baths, which are environmentally undesirable and it is also difficult to deposit a plated layer with sufficient thickness to achieve the desired corrosion-resistant and/or abrasion-resistant effects.

The use of powder coating techniques are useful for coating the exterior surfaces of structures, but no efficient powder coating techniques have been developed for coating the interior surfaces of structures, such as metal casings. Similarly, the chemical vapor deposition and physical vapor deposition techniques, such as evaporation, ion plating, and sputtering, have not been adequately developed for coating interior surfaces such as the inside of a metal casing.

Another approach that has been used to metallize the interior of metallic casings involve the placing of alloy powder into the interior of the pipe and then heating the pipe with induction heating coils. However, the currently known techniques, as exemplified in U.S. Pat. Nos. 5,919,307, 5,413,638 and 5,059,453 all present certain operational problems. Specifically, the '307 patent requires the coating alloy to be contained within a fluid degradable transport material and requires a casing to be coated to be filled with this material. The dispersion of coating alloy and transport material must be specially prepared and the ends of the casing must be sealed to prevent leakage. The technique disclosed in the '638 patent requires the complex apparatus with a plurality of rollers designed to accommodate the metal casing as it changes in diameter while being heated and requires the casing to be passed through the heating apparatus. The costs required to construct the apparatus disclosed in the '638 patent are substantial. The technique disclosed in the '453 patent requires the coating materials provided in elongated rods that are placed longitudinally within the casing. Thus the elongated rods of alloy material must also be specially prepared. The induction heating process of the '453 patent also requires a complex apparatus as the casing must be transported through the induction heating mechanism.

Thus, there is a need for an improved and simplified apparatus and method for coating the interior of metallic tubular bodies which is easier and less costly to employ.

SUMMARY OF THE DISCLOSURE

In satisfaction of the aforenoted needs, methods for coating an interior surface of a metallic tube with an alloy are disclosed. One disclosed method comprises placing a quantity of an alloy in the tube, enclosing the ends of the tube with caps, at least one of which is vented, heating the tube with resistance heating by applying current across the tube sufficient to heat the tube and melt the alloy, and spinning the tube about a longitudinal axis of the tube to distribute the molten alloy along the interior surface of the tube using centrifugal forces generated by the spinning of the tube.

Apparatuses for coating an interior of a metallic tube with an alloy are also disclosed. One disclosed apparatus comprises a vertically adjustable support for supporting the metallic tube in a horizontal position. The apparatus also comprises at least two spaced-apart rollers and up to several sets of rollers in alignment with the vertical support for receiving the tube when the support is lowered to place the tube on the rollers in a horizontal position. At least one of the rollers is linked to a drive mechanism for rotating the roller and imparting rotation to the tube. The apparatus also includes two electrodes for detachable connection to opposing ends of the tube which are used to heat the tube, with the alloy disposed therein, prior to the placement of the tube on the rollers. The apparatus also includes two caps, at least one of which is vented for releasing gases generated during the heating and subsequent spinning of the tube. The apparatus may also include a supply of inert gas connected to one of the caps. The apparatus may also include a cooling mechanism such as a coolant spray device or a quench tank.

BRIEF DESCRIPTION OF THE DRAWINGS

The disclosed apparatuses and methods are described more or less diagrammatically in the accompanying drawings wherein.

It should be understood that the drawings are not to scale and the embodiments are illustrated by graphic symbols, phantom lines, diagrammatic representations and fragmentary views. In certain instances, details which are not necessary for an understanding of the disclosed apparatuses and methods or which render other details difficult to perceive may have been omitted. It should be understood, of course, that this disclosure is not limited to the particular embodiments illustrated herein.

DETAILED DESCRIPTION OF THE PRESENTLY PREFERRED EMBODIMENTS

Figure 1:
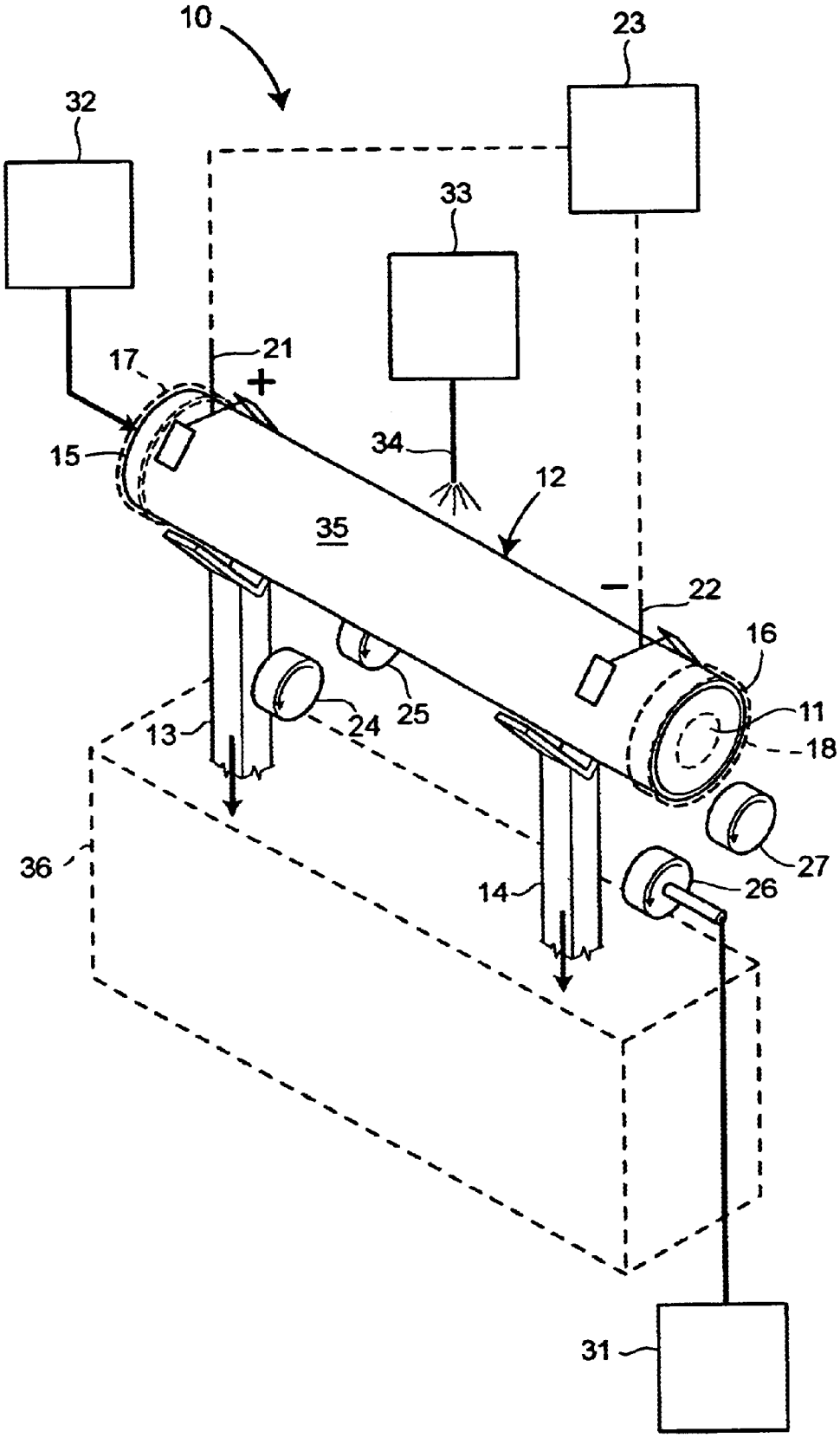
FIG. 1 is a perspective/schematic illustration of an apparatus used to coat an interior surface of a metallic tube with an alloy in accordance with this disclosure.

An apparatus 10 used to coat an interior surface 11 of a metallic tube 12 is disclosed in FIG. 1. The tube 12 is supported on vertically adjustable supports 13, 14 in a horizontal position as shown. Alloy material is placed within the tube 12 and the opposing ends 15, 16 of the tube are covered with caps shown in phantom at 17, 18. A positive electrode 21 and a negative electrode 22 are attached or placed into engagement with the tube 12 near the opposing ends 15, 16 thereof. The electrodes 21, 22 are connected to a power supply 23. With the alloy material in place along the interior 11 of the tube 12, the tube is heated by applying current across the tube, by way of the electrodes 21, 22 resulting in a resistance heating of the tube 12. Heat is transferred from the tube 12 to the alloy material contained within the tube and, because the alloy material within the tube has a lower melting point than the material of the tube 12 itself, the alloy material melts. With the alloy material in a molten state, the vertical support 13, 14 are lowered so that the tube 12 rests on the rollers 24–27. One or more of the rollers, e.g., roller 26 as shown in FIG. 1, is connected to a drive mechanism 31. With the alloy in a molten state and the hot tube 12 resting on the rollers 24–27, rotation is imparted to the tube, through the rollers, e.g., roller 12, to rotate the tube resulting in a distribution of a molten alloy along the interior surface 11 of the tube 12. Several pairs of rollers may be required to prevent warping or bowing at the elevated temperatures required to melt the alloy coating. Thus, the apparatus 10 enables the tube 12 to be coated with an alloy material using a resistant heating technique.

The apparatus 10 may also include a gas supply 32 that is coupled to one of the end caps, e.g., 17, as shown in FIG. 1. The gas supply 32 may be an inert gas supply which may improve the structure of the alloy/casing bond along the interior 11 of the tube 12. Also, the gas supply 32 may simply be a supply of air used to enhance the cooling of the tube during the spinning of the tube on the rollers 24–27. Further, a separate inert gas supply and oxygen supply may be provided.

Two cooling mechanisms are illustrated in FIG. 1, although it will be understood by those skilled in the art that additional cooling mechanisms may be employed. A supply of coolant 33 may be provided and connected to a spray nozzle 34 which sprays coolant, e.g., water or other suitable coolant, to the exterior surface 35 of the tube during the spinning of the tube on the rollers 24–27. Also, a quench tank 36 may be provided and the entire tube 12 may be placed in the liquid-filled quench tank after the spinning on the rollers 24–27 and distributing of the alloy about the interior 11 of the tube 12.

Figure 2:
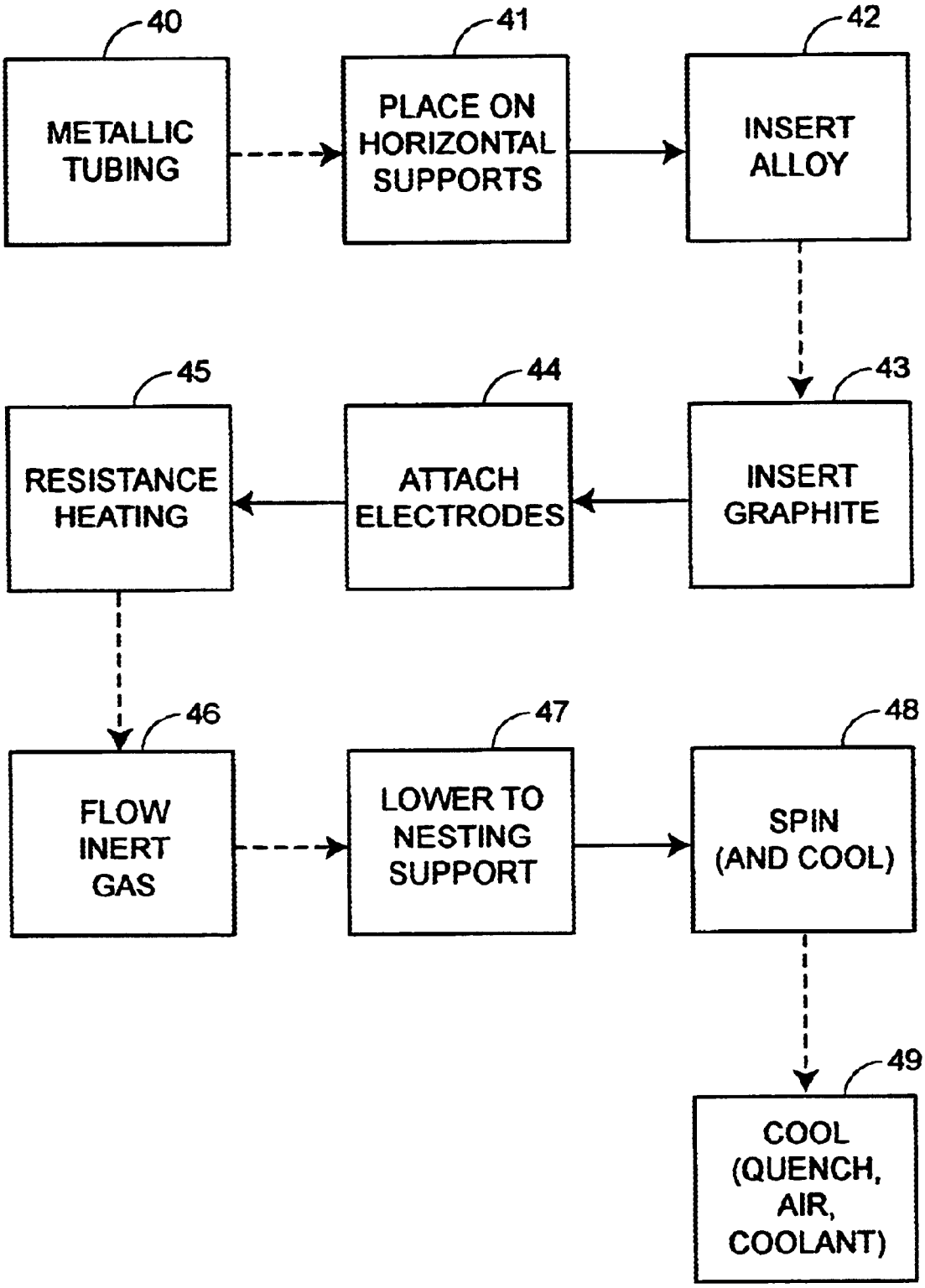
FIG. 2 is a flow diagram illustrating the various methods for coating an interior surface of a metallic tube with an alloy in accordance with this disclosure.

A flow diagram for the above-described methods is illustrated in FIG. 2. Metallic tubing is provided at step 40 and placed on horizontal supports at 41. The alloy is then inserted at 42. Optionally, a step 43 may be included which inserts graphite with the alloy. The addition of graphite with the alloy would help to remove oxygen from the tube during the melting and casting of the alloy about the interior surface of the tube. The electrodes are attached at 44 and the resistance heating is carried out at 45. Again, inert gas may be flowed through the tube at 46 to improve the bonding characteristics. After heating, the tube is lowered to a nesting support or, an appropriate set of rollers at 47 where the tube is spun at 48 prior to being cooled at 49. The additional cooling step is not required, the cooling may take place at ambient temperature on the rollers. Also, it would be possible to combine the rollers and the vertically adjustable horizontal supports into a single set of components.

Figure 3:
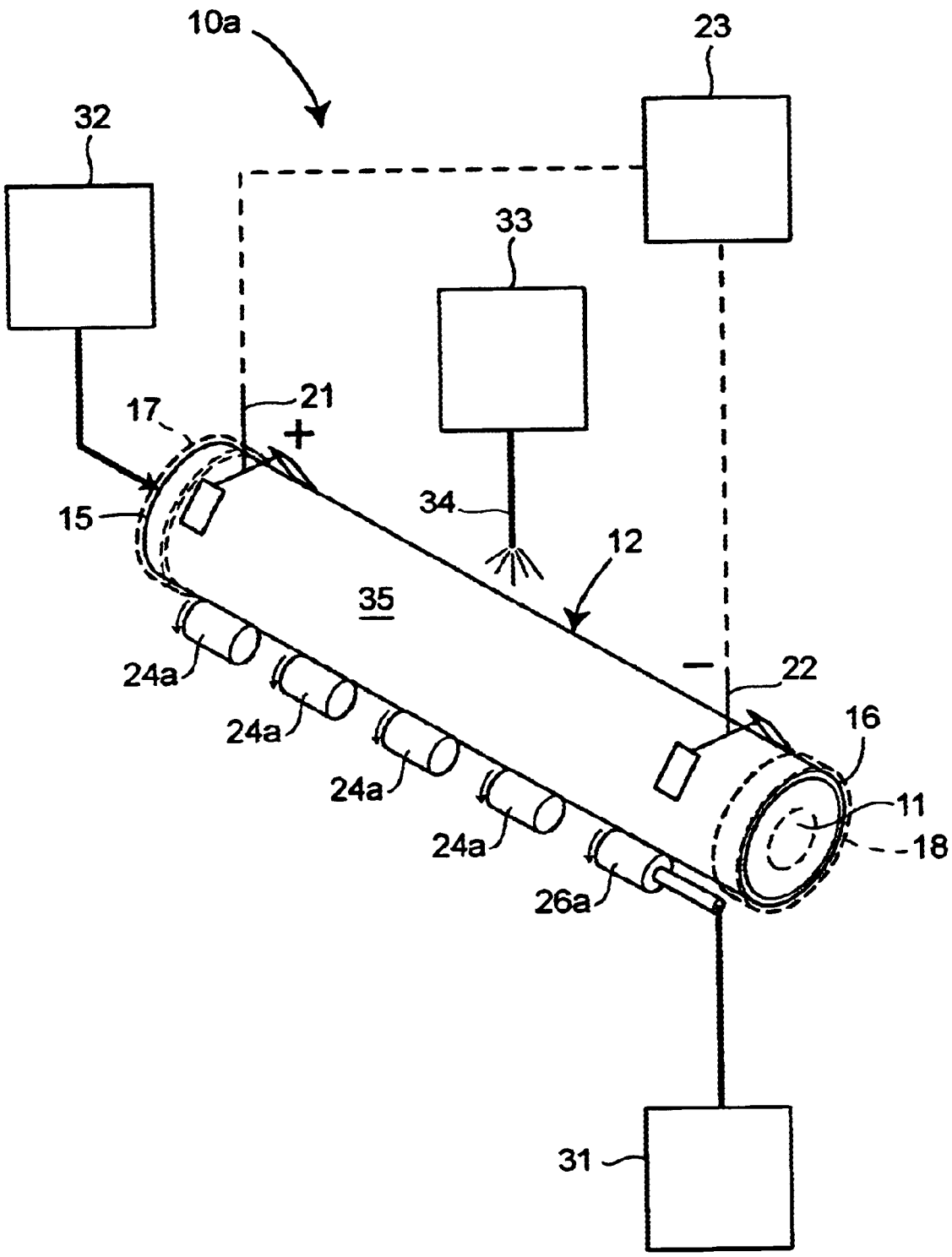
FIG. 3 is a perspective/schematic illustration of another apparatus used to coat an interior surface of a metallic tube with an alloy in accordance with this disclosure and, similar to the apparatus shown in FIG. 1, but with fixed non-conductive rollers that are used to support the metallic tube during the resistance heating thereof.

An alternative embodiment 10*a* is shown in FIG. 3 which eliminates the adjustable vertical supports 13, 14. Instead, a plurality of pairs of fixed, non-conductive rollers, one roller of each pair shown at 24*a*, 26*a*, supports the tube 12 during the resistance heating thereof.

Suitable alloys for casting in accordance with the above-described methods include nickel alloys. Nickel-chromium alloys can generally be used as corrosion-resistant alloys and tungsten-carbon-nickel alloys can be generally used as abrasion resistant alloys. Suitable casing materials include alloy steels which all have sufficiently high melting points and resistant values. The amount of current required to carry out the resistance heating of the tubing 12 will vary depending upon the materials of construction for the tubing and the thickness of the tubing. The time required for the heating step will also vary greatly, depending upon the tubing alloy, the thickness of the tubing and the length of the tubing. The time required to carry out the spinning step will also vary depending upon the amount of alloy needed to satisfactorily coat the interior surface of the tubing.

The length of the tubing 12 to be processed using the resistance heating methods and apparatuses disclosed above can vary greatly and will not be limited by the size of a furnace. Again, no furnace is required, just the use of two electrodes mounted at opposing ends of the tubing. Further, it has been found that resistance heating is faster and therefore more economical than induction or radiant heating as taught by the prior art. Still further, as shown in FIGS. 1 and 2, quenching or cooling equipment may be easily integrated in a space-efficient manner.

While only certain embodiments have been set forth, alternative embodiments and various modifications will be apparent from the above description to those skilled in the art. These and other alternatives are considered equivalents and within the spirit and scope of the appended claims.

What is claimed is:

1. A method for coating an interior surface of a metallic tube with a first alloy, the tube comprising at least one open end and an interior surface, the method comprising:

placing a quantity of a first alloy in the tube, the first alloy being in a solid form selected from the group consisting of powder, shots and pellets;

enclosing the at least one open end of the tube with a cap;

heating the tube by applying current across the tube sufficient to heat the tube and melt the first alloy;

lowering the tube and first alloy to a nesting fixture comprising two pairs of rollers spaced apart from each other along a longitudinal axis of the tube, the nesting fixture providing a horizontal support for the tube;

rotating at least one of said rollers to spin the tube about a longitudinal axis of the tube to distribute the molten first alloy along the interior surface of the tube.

2. The method of claim 1 wherein the cap comprises a pressure release mechanism.

3. The method of claim 1 wherein the tube comprises a second alloy, the first alloy having a lower melting point than the second alloy.

4. The method of claim 1 wherein the tube comprises a second alloy, the first and second alloys being soluble in one another.

5. The method of claim 1 wherein the metallic tube has an electrical resistance that is greater than the electrical resistance of copper.

6. The method of claim 1 wherein the nesting fixture is electrically insulated.

7. The method of claim 1 wherein the heating the tube by applying current across the tube comprises connecting two electrodes to the tube, the electrodes being spaced apart longitudinally along the tube.

8. The method of claim 7 wherein the tube is held in place by a horizontal support during the heating the tube by applying current across the tube and the method further comprises:

lowering the horizontal support to place the tube and first alloy on a nesting fixture between the heating and spinning of the tube and first alloy.

9. The method of claim 8 wherein the nesting fixture is electrically insulated from the electrodes.

10. The method of claim 7 wherein the tube is held in place by non-conductive rollers during the heating the tube by applying current across the tube.

11. The method of claim 1 further comprising placing graphite in the tube with the first alloy.

12. The method of claim 2 wherein the cap is a vented cap.

13. The method of claim 2 wherein the cap comprises a hole for releasing gas.

14. The method of claim 1 further comprising flowing inert gas into the tube during the heating of the tube.

15. The method of claim 1 further comprising cooling the tube and first alloy.

16. The method of claim 15 wherein the cooling comprises flowing air into the tube during the spinning thereof.

17. The method of claim 15 wherein the cooling comprises applying coolant to an exterior of the tube during the cooling thereof.

18. The method of claim 15 wherein the cooling comprises quenching the tube and first alloy in a coolant after the spinning thereof.

19. A method for coating an interior surface of a metallic casing with a first alloy, the casing comprising two open ends and an interior surface, the method comprising:

placing a quantity of a first alloy in the casing sufficient to coat the interior surface of the casing the first alloy being in a solid form selected from the group consisting of powder, shots and pellets;

enclosing both open ends of the casing with caps, at least one of the caps comprising a pressure release mechanism;

lowering the tube and first alloy to a nesting fixture comprising two pairs of rollers spaced apart from each other along a longitudinal axis of the tube, the nesting fixture providing a horizontal support for the tube;

heating the casing by engaging two electrodes in a longitudinally spaced apart fashion with the casing and applying current across the casing sufficient to heat the casing and melt the first alloy;

spinning the casing on the rollers about a longitudinal axis of the casing to distribute the molten first alloy along the interior surface of the casing while continuing to heat the casing by applying said sufficient current across the casing;

cooling the casing and the first alloy.

20. The method of claim 19 wherein the casing comprises a second alloy, the first and second alloys being soluble in one another.

21. The method of claim 19 wherein the rollers are electrically insulated from the electrodes.

22. The method of claim 19 further comprising flowing inert gas into the casing during the heating of the casing.

23. The method of claim 19 further comprising placing graphite in the tube with the first alloy.

* * * * *